US007117646B2

(12) United States Patent
Blaisdell et al.

(10) Patent No.: US 7,117,646 B2
(45) Date of Patent: Oct. 10, 2006

(54) PRIVACY ENCLOSURE

(75) Inventors: George Blaisdell, Siler City, NC (US); Jay Hood, Durham, NC (US); Mike Bernhard, Morrisville, NC (US); Joe Bierman, Raleigh, NC (US)

(73) Assignee: Triumph Boats, Inc., Durham, NC (US)

( * ) Notice: Subject to any disclaimer, the term of this patent is extended or adjusted under 35 U.S.C. 154(b) by 0 days.

(21) Appl. No.: 10/623,476

(22) Filed: Jul. 18, 2003

(65) Prior Publication Data

US 2005/0011430 A1 Jan. 20, 2005

(51) Int. Cl.

| | |
|---|---|
| ***E04H 1/12*** | (2006.01) |
| ***A47K 11/00*** | (2006.01) |
| ***B60R 15/04*** | (2006.01) |
| ***B63B 29/14*** | (2006.01) |

(52) U.S. Cl. ..... 52/79.5; 52/67; 4/449; 114/361; 114/364

(58) Field of Classification Search ..... 114/343, 114/354, 361, 363, 364; 4/300, 312, 449, 4/459, 460, 476, 526, 531, 532, 599, 600, 4/DIG. 2, 644; 52/67, 68, 79.5; 135/128, 135/143; 296/165, 169, 173, 26.01, 26.02, 296/26.03; 244/118.5; 312/228, 228.1
See application file for complete search history.

(56) References Cited

U.S. PATENT DOCUMENTS

| | | | | | |
|---|---|---|---|---|---|
| 200,480 | A | * | 2/1878 | Rivera | 312/226 |
| 316,324 | A | * | 4/1885 | Barnwell | 4/664 |
| 345,890 | A | * | 7/1886 | Farson | 4/420.3 |
| 1,409,330 | A | * | 3/1922 | Aper | 312/228 |
| 2,014,554 | A | | 9/1935 | Bulthuis | |
| 3,352,596 | A | * | 11/1967 | Escoto | 296/169 |
| 3,629,875 | A | | 12/1971 | Dow | |
| 4,012,070 | A | * | 3/1977 | Mertz | 296/175 |
| 4,691,657 | A | * | 9/1987 | Kovac | 114/344 |
| 4,883,016 | A | | 11/1989 | Larson | |
| 4,974,265 | A | | 12/1990 | Maggio | |
| 4,979,242 | A | | 12/1990 | Maggio | |
| 5,029,348 | A | | 7/1991 | Boren | |
| 5,209,177 | A | | 5/1993 | Granie et al. | |
| 5,331,917 | A | | 7/1994 | Magers | |
| 5,379,466 | A | | 1/1995 | Davies | |
| 5,673,962 | A | * | 10/1997 | Maieli et al. | 296/164 |
| 5,778,462 | A | | 7/1998 | Bjorklund et al. | |
| 6,007,025 | A | * | 12/1999 | Coughren et al. | 244/118.6 |
| 6,079,669 | A | * | 6/2000 | Hanay et al. | 244/118.5 |
| 6,263,825 | B1 | | 7/2001 | Davidson | |
| 6,302,053 | B1 | | 10/2001 | Tomczak et al. | |
| 6,302,475 | B1 | * | 10/2001 | Anderson | 296/175 |
| 2001/0044952 | A1 | | 11/2001 | Becker | |

FOREIGN PATENT DOCUMENTS

| | | | | |
|---|---|---|---|---|
| DE | 1455486 B | * | 12/1969 | 296/26.01 |
| DE | 2423561 A | * | 11/1975 | |

(Continued)

*Primary Examiner*—Ajay Vasudeva
(74) *Attorney, Agent, or Firm*—Merchant & Gould P.C.

(57) ABSTRACT

A privacy enclosure for use on a boat. The privacy enclosure includes a plurality of rigid wall structures that raise in a first vertical direction and extend in a second lateral direction to provide sufficient space for use as a changing room. The privacy enclosure includes a compartment within which a toilet may be located. The toilet can be slid out from the compartment into the interior of the enclosure for use.

4 Claims, 11 Drawing Sheets

FOREIGN PATENT DOCUMENTS

| | | | | |
|---|---|---|---|---|
| FR | 2346507 | A | * | 12/1977 |
| FR | 2754504 | A1 | * | 4/1998 |
| JP | 64029240 | A | * | 1/1989 |
| JP | 02204146 | A | * | 8/1990 |
| JP | 11028240 | A | * | 2/1999 |
| JP | 2000027270 | A | * | 1/2000 |
| WO | WO 7900790 | A | * | 10/1979 |
| WO | WO 200101832 | A1 | * | 1/2001 |

* cited by examiner

PRIVACY ENCLOSURE

TECHNICAL FIELD

This disclosure relates generally to a privacy enclosure. More particularly, this disclosure relates to a stowable privacy enclosure designed for use on a boat.

BACKGROUND

A wide variety of enclosure arrangements have been provided for personal use on boats. A number of such enclosure arrangements include a soft-sided or fabric arrangement, such as a rail and curtain arrangement. In some arrangements, a curtain is drawn around an area for use as a changing area or a private toilet area. In other arrangements, a soft-sided fabric canopy unfolds to enclose a changing or toilet area.

The soft-sided fabric/curtain arrangements have several drawbacks. For instance, conventional curtain or fabric arrangements provide little to no structural stability, which can cause safety concerns in conditions when the boat is rocking and a user looses his or her balance. Without structural supports and having nothing to grasp, a user may fall through the curtain or fabric sides of the enclosures. Another drawback of these conventional arrangements is a lack of secured privacy, which can arise when the wind is blowing and the curtain or fabric side blows up or open. In addition, soft-sided arrangements generally provide no noise privacy or noise dampening that in tight quarters on a boat is desirable.

A need exists for a privacy enclosure having structural features to address such concerns for safety, secured privacy, and noise privacy. And yet, as can be understood, full-sized structures or cabin rooms addressing these needs can consume a substantial amount of space or be impractical on smaller boat configurations. Thus, it is further desirable to provide a privacy enclosure that can be stowed when not in use.

In general, improvement has been sought with respect to such enclosures, generally to better accommodate privacy, safety, and spatial concerns.

SUMMARY

One aspect of the present disclosure relates to a privacy enclosure having a rigid enclosure structure. The rigid enclosure structure is configured to lift and extend from a stowed configuration to an expanded configuration. The rigid enclosure structure lifts and extends to provide expansion in a first vertical direction and a second lateral direction.

Another aspect of the present disclosure relates to a privacy enclosure having a plurality of rigid walls defining an interior. The plurality of rigid walls includes at least a first rigid wall and a second rigid wall. The first rigid wall is configured to pivot upward from a first position to a generally vertical position. The second rigid wall is configured to laterally extend in a direction outward from the first rigid wall.

Still another aspect of the present disclosure relates to privacy enclosure arrangement including a stowable enclosure coupled to a lower base. A rigid outer wall structure of the stowable enclosure and a portion of the lower base define an interior of the privacy enclosure arrangement. A storage compartment is located adjacent to the interior; A toilet is positioned within the storage compartment and is arranged to selectively slide out of the storage compartment for use when the rigid outer wall structure is in an expanded configuration.

Another aspect of the present disclosure relates to a boat having a privacy enclosure. The privacy enclosure includes a structure having a rigid exterior. The rigid exterior includes a plurality of walls and a door hinged to one of the walls. The structure can be selectively positionable in a collapsed configuration and an expanded configuration. In certain embodiments, the privacy enclosure can house a toilet and include sufficient space adjacent to the toilet to allow the enclosure to also be used as a changing room.

And still, another aspect of the present disclosure related to a method of expanding a privacy enclosure including raising an enclosure structure from a reduced height to a raised height, and laterally expanding the enclosure structure from a first length to a second increased length.

A variety of examples of desirable product features or methods are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Reference will now be made in detail to various features of the present disclosure that are illustrated in the accompanying drawings. Wherever possible, the same reference numbers will be used throughout the drawings to refer to the same or like parts.

Figure 1:
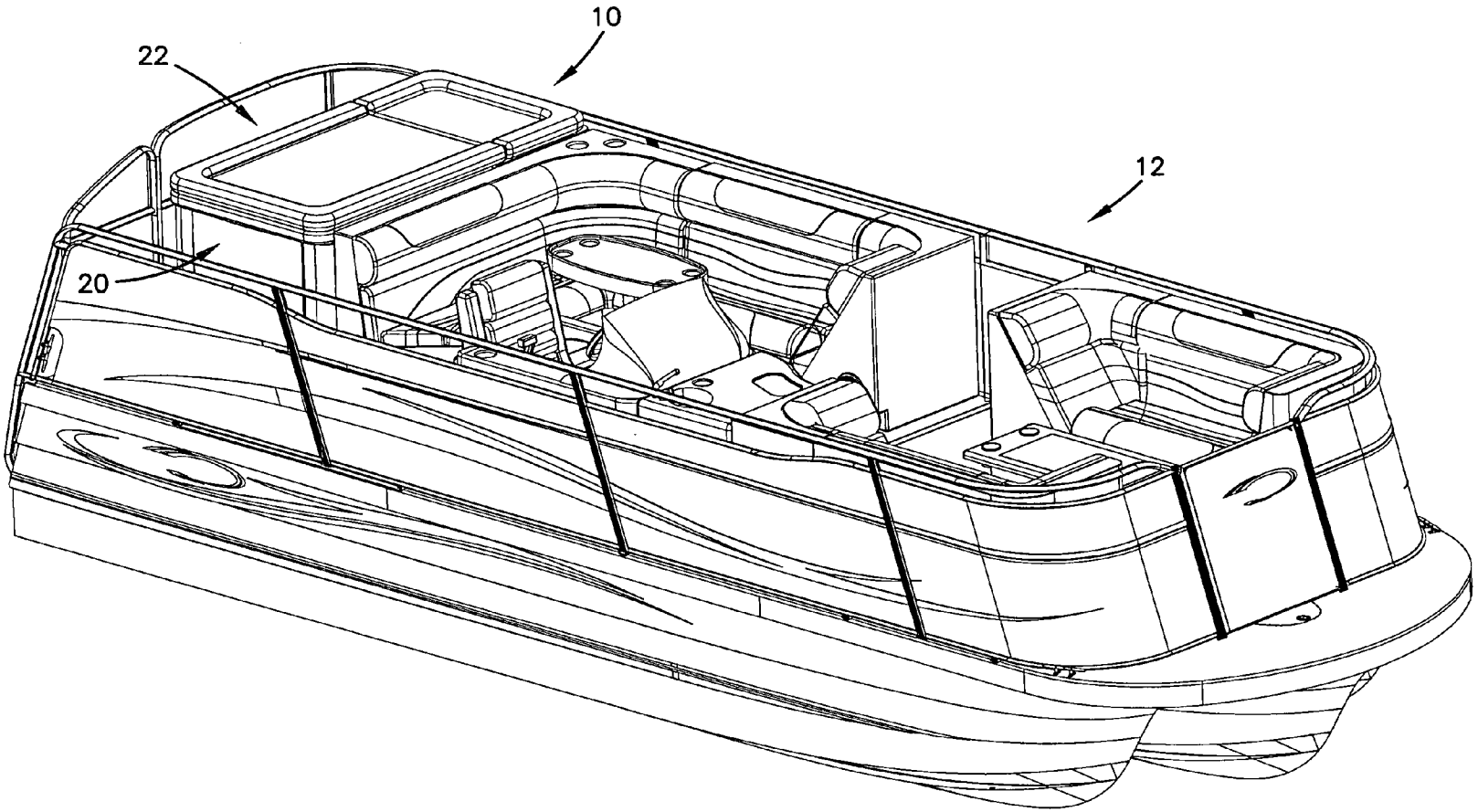
FIG. 1 is a perspective view of one embodiment of a boat having one embodiment of a privacy enclosure, shown in a stowed configuration, according to the principles of the present disclosure.
Figure 2:
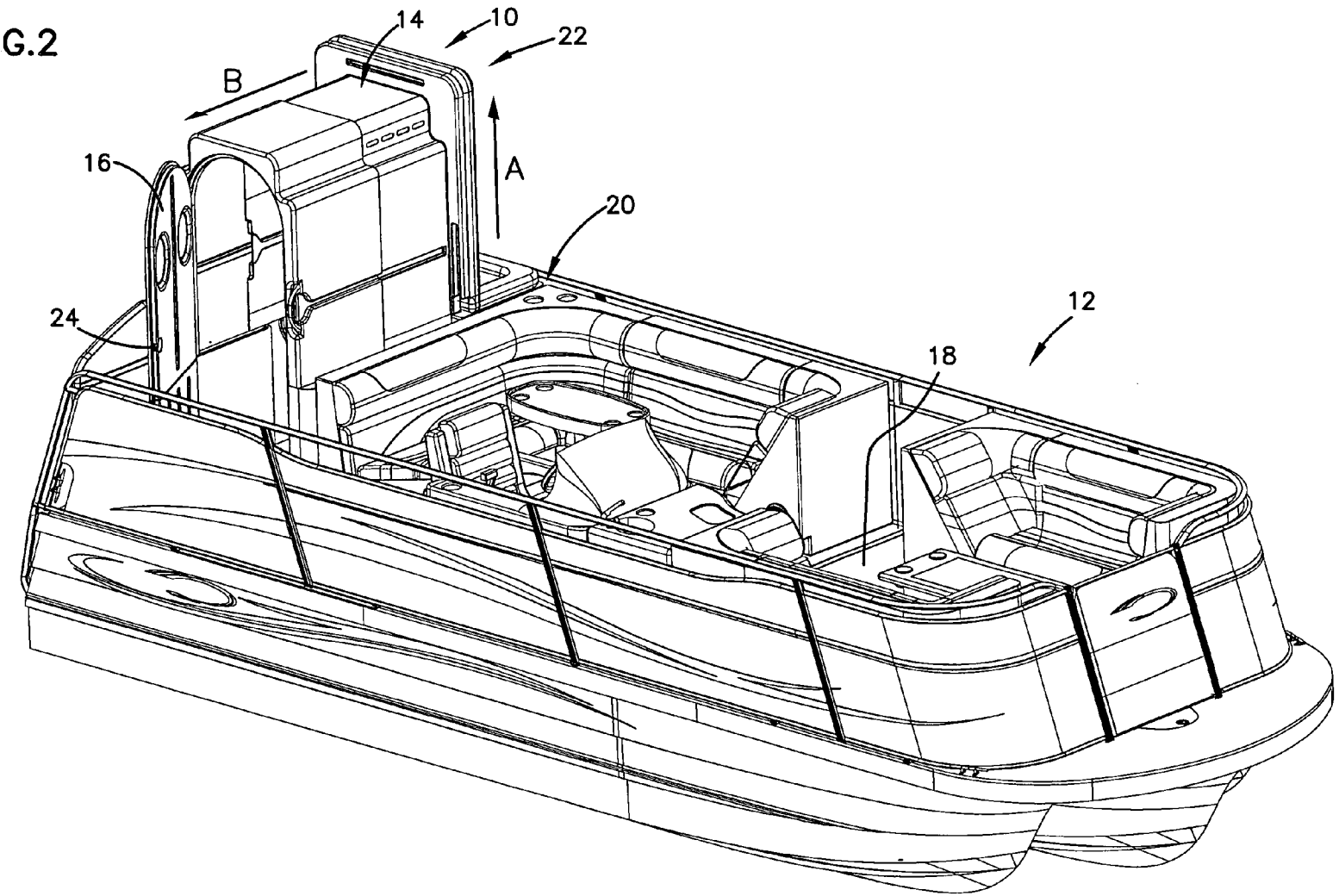
FIG. 2 is a perspective view of the boat of FIG. 1, showing the privacy enclosure in an expanded configuration.

FIGS. 1 and 2 illustrate one embodiment of a privacy enclosure 10 in accord with the principles disclosed. The privacy enclosure 10 is illustrated in use on a boat 12, for example, a pontoon boat. It is contemplated that the principles of the present disclosure can be practiced to adapt the disclosed privacy enclosure for use on a variety of boat types, or for use in a variety of non-boat related applications.

The privacy enclosure 10 generally includes an enclosure structure 14 (FIG. 2) having a rigid construction. A rigid construction is a construction that is more rigid than a curtain, for example. Preferably the walls of the enclosure structure 14 are sufficiently rigid so that the walls are self-supporting and maintain a particular shape without additional structural support. That is, the enclosure structure can maintain an area and volume without, for example, struts, arms, trusses, a framework, or railings as required by some conventional fabric or curtain arrangements.

One advantage of the rigid construction of the privacy enclosure 10 is that the enclosure will maintain the privacy of the user even during windy conditions. Unlike a curtain or fabric arrangement, wind or heavy rocking conditions will not cause the enclosure to blow open or expose a user in the privacy enclosure. In addition, the rigid construction of the privacy enclosure permits a user to support himself by grasping or holding onto the enclosure if the user looses his balance.

In the preferred embodiment, the enclosure structure 14 has a sound or noise-inhibiting construction to provide better noise privacy or dampening in comparison to conventional fabric or curtain arrangements. In the illustrated embodiment, the enclosure structure 14 is a solid construction having a particular structural thickness. Preferably, the enclosure structure 14 has a wall thickness of about 0.125 inches to 0.25 inches; more preferably the enclosure structure 14 has a structural thickness of at least 0.125 inches. In one embodiment, the enclosure structure can be made of a plastic material, such as polyethylene, having a thickness of about 0.187 inches, for example. The construction can also include insulating materials (not shown), for example, to further inhibit noise. In general, the privacy enclosure is constructed such that use of the privacy enclosure is less audible than conventional fabric or curtain arrangements.

In the preferred embodiment, the rigid enclosure structure 14 is selectively positionable in a collapsed or stowed configuration (shown in FIG. 1) and an expanded configuration (shown in FIG. 2). As will be discussed in greater detail hereinafter, the rigid enclosure structure 14 expands from the stowed configuration to the fully expanded configuration in both a first vertical direction (represented by arrow A in FIG. 2) and a second lateral direction (represented by arrow B). In the stowed configuration, the privacy enclosure can be use as a bench; in the expanded configuration, the privacy enclosure can be used as a changing room or a private toilet area. The privacy enclosure 10 includes a door 16 that opens and closes for selective access to the changing room/private toilet area. Typically, a door latch 24 is provided to secure the door 16 when closed.

In the illustrated embodiment, the privacy enclosure is located on an upper deck 18 of the boat 12. In one embodiment, the privacy enclosure 10 is fixedly secured to the deck 18. For example, the enclosure 10 can be fixed to the deck 18 by fasteners, by bonding material, by integrally molding the enclosure with the boat deck, or by otherwise affixing the enclosure to the deck 18. In other embodiment, the enclosure may be removable from the deck 18. Still yet, the enclosure may be used in other applications than that of a boat. In the depicted embodiment, a lower region 20 of the privacy enclosure is fixed to the deck 18 of the boat 12 and an upper region 22 of the privacy enclosure is configured to expand or open.

Figure 3:
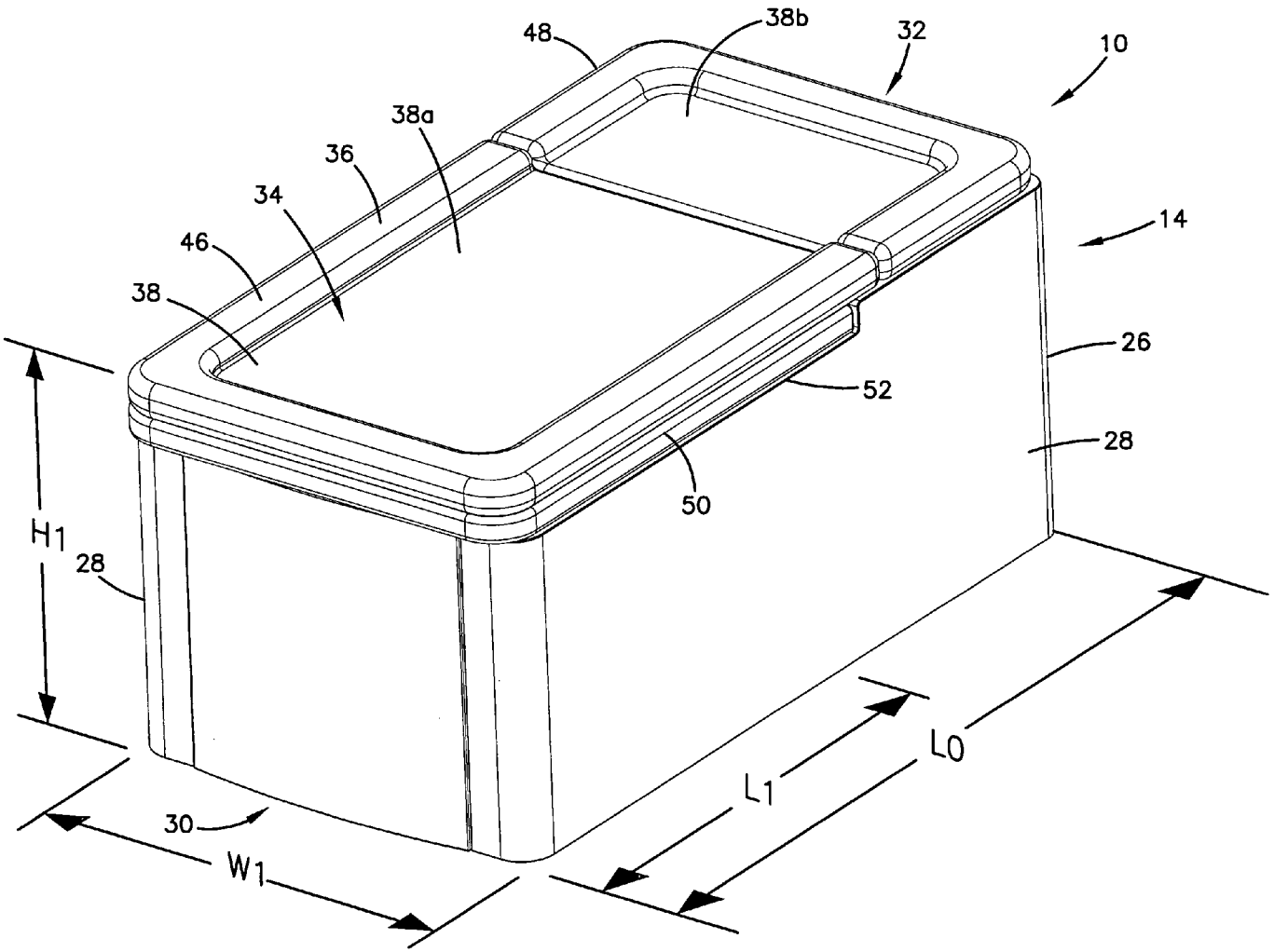
FIG. 3 is an isolated perspective view of the privacy enclosure of FIG. 1, shown in the stowed configuration.

Referring now to FIG. 3, the rigid enclosure structure 14 generally includes a generally rectangular base 26 having lower sidewalls 28, a front or first end 30, a back or second end 32, and a top cover 34. In the stowed orientation of FIG. 3, the top cover 34 seats upon a top perimeter defined by the first and second ends 30, 32 and the lower sidewalls 28. In the stowed configuration as shown in FIG. 3, the top cover 34 can be used as bench seating or a sundeck. The illustrated top cover 34 includes a cushioned bumper 36 and padding 38 for seating and sunning comfort. It is contemplated that the top cover 34 of the privacy enclosure 10 can include other padding or structure configurations, such as conformed seats for example. In the alternative, the top cover can be configured for use a table or top storage area.

The top cover 34 includes a first cover section 46 and a second cover section 48. The first cover section 46 includes a rigid structure or wall 50 positioned beneath padding 38*a* of the top cover 34. The wall 50 fits within a stepped region 52 formed in the lower sidewalls 28 of the base 26. As will be described in greater detail hereinafter, the first cover section 46 is configured to lift, pivot, or rise relative to the second cover section 48.

In general, the base 26 has an overall width W1, an overall height H1, and an overall length L0, although the disclosed principles can be applied in a variety of sizes and applications. The width W1 of the base 26 is generally defined between lower sidewalls 28, and is preferably between 30 and 42 inches; and most preferably about 38 inches. The height H1 of the base 26 is generally defined between the deck 18 of the boat (FIG. 2) and the top cover 34, and is preferably between 24 and 36 inches; more preferably between 24 and 30 inches; and most preferably about 30 inches. The length L0 of the base 26 is generally defined between the first and second ends 30, 32 of the base and is preferably between 5 and 7 feet; and most preferably about 6 feet.

Figure 4:
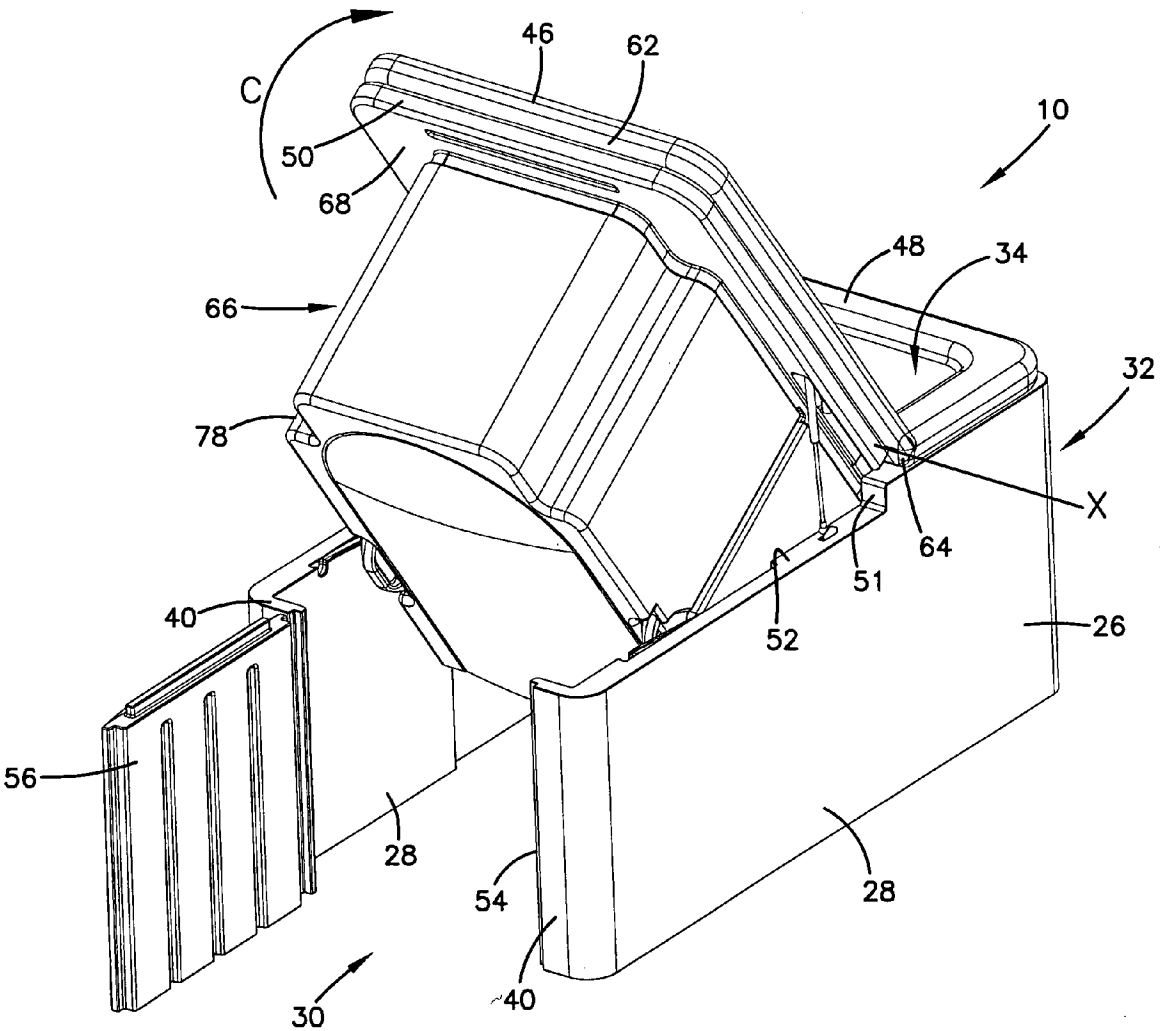
FIG. 4 is a perspective view of the privacy enclosure of FIG. 3, shown in a partially pivoted position.

Referring now to FIG. 4, the front end 30 of the base 26 defines an opening 54. A first door section 56, which define the front end 30, is hingedly mounted at the opening 54. The door section 56 is mounted between front extensions 40 integrally formed with the sidewalls 28. The first door section 56 is configured to selectively open and close to permit movement of the first cover section 46.

Figure 5:
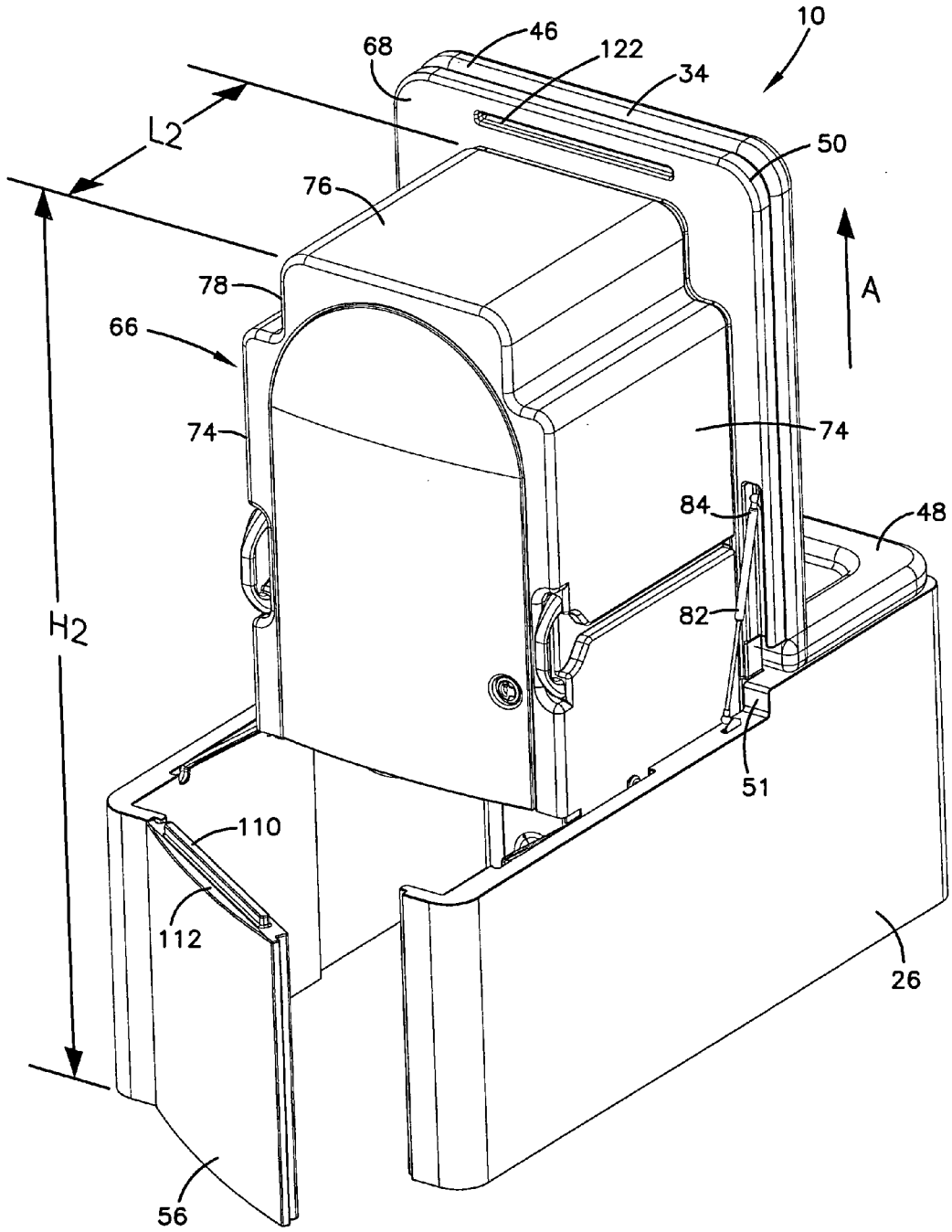
FIG. 5 is a perspective view of the privacy enclosure of FIG. 4, shown in a fully pivoted position.

In particular, a first end 62 of the first cover section 46 can be rotated or pivoted upward (represented by arrow C) relative to the second cover section 48 about an axis X defined at a second end 64 of the first cover section 46. A rigid wall construction 66 is attached to an undersurface 68 of the wall 50. As the first cover section 46 is raised or lifted, the rigid wall construction 66 pivots from a stowed, lowered position to an upright or raised position. By pivoting or raising the first cover section 46 and the rigid wall construction 66, the privacy enclosure 10 expands in the first vertical direction as represented by arrow A (FIG. 5). In the upright position, the wall 50 of the top cover 34 serves as a rigid back wall of the privacy enclosure 10 and is generally oriented in a vertical position.

Figure 11:
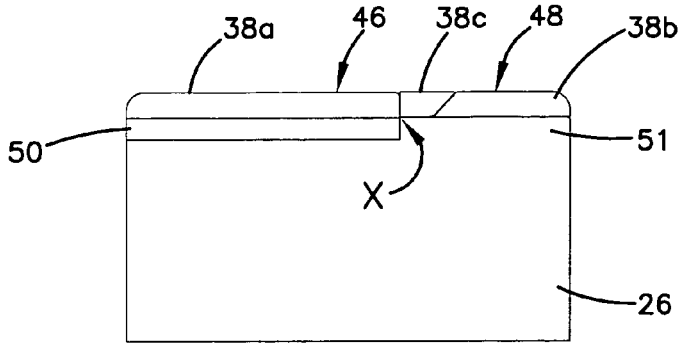
FIG. 11 is a side view of the enclosure equipped with a filler cushion that facilitates pivoting the enclosure open without interference between the cushions.
Figure 12:
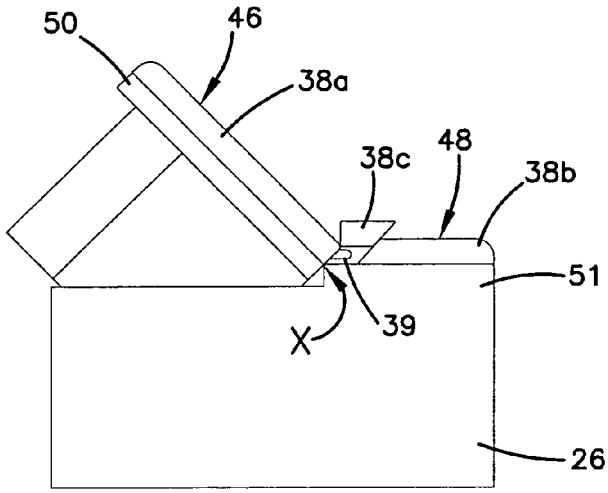
FIG. 12 shows the enclosure of FIG. 11 with the pivotal top cover pivoted partially open.
Figure 13:
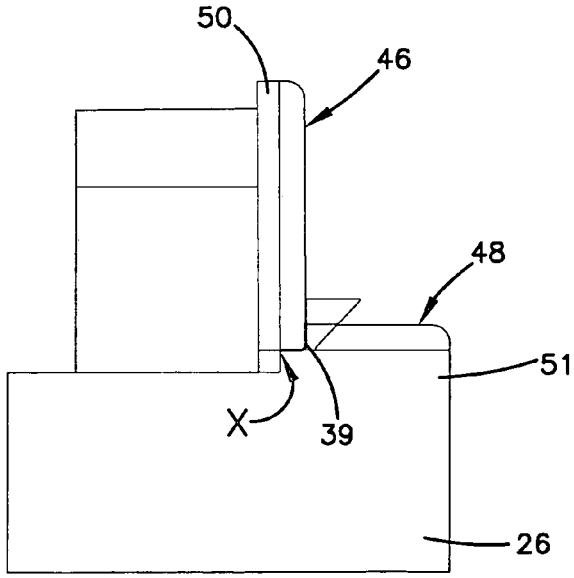
FIG. 13 shows the enclosure of FIG. 11 with the pivotal top cover pivoted fully upright.

The second cover section 48 includes a cushion or padding 38*b* mounted on a rigid wall 51. The first section 46 is connected to the second section 48 by one or more hinges (e.g., a piano-like hinge that extends across the width of the enclosure) that provide a pivotal connection between wall 50 and wall 51. As shown in FIGS. 11–13, the padding 38 can include a filler cushion 38*c*(not shown in FIGS. 3–10) positioned between cushions 38*a*, 38*b*. The filler cushion 38*c* is configured to prevent interference between cushions 3*a*, 38*b* as the first cover section 46 is pivoted relative to the second cover section 48. In certain embodiments, a flexible flap 39 of material connects cushion 38*a* to cushion 38*c*. When the enclosure is in the closed position of FIG. 11, the flap 39 folds under the cushion 38*c*.

As shown in FIG. 3, the first cover section 46 of the top cover 34 has a length L1 defined between the first end 62 and the second end 64. The length L1 of the first cover section 46 is preferably between 42 and 54 inches; and most preferably at least 36 inches.

Referring now to FIG. 5, the wall construction 66 includes opposing rigid sidewalls 74 and an interconnecting wall 76 (or top wall) extending between the opposing sidewalls 74. The top wall 76 includes a neck portion 78. The neck portion 78 provides added head room in the privacy enclosure 10 when the wall construction 66 is positioned in the upright position. In addition, the neck portion 78 reduces the overall length requirement of the base 26, and thus minimizes space utilization of the privacy enclosure, while still providing the added head room.

Specifically, the neck portion 78 of the privacy enclosure 10 is sized such that when the first door section 56 of the base 26 is selectively opened (FIG. 4), the neck portion 78 fits through the opening 54 of the base 26 so that the first cover section 46 and the wall construction 66 can be pivoted or rotated upward. Without the neck portion 78 and the clearance opening 54 of the base 26, the base 26 would have to be longer to accommodate the pivoting movement of the wall construction 66.

Still referring to FIG. 5, the privacy enclosure 10 may include one or more gas shocks or air cylinders 82 (see also FIG. 9) or other devices coupled to the wall 50 and base 26 to assist in pivoting or raising the first cover section 46 and wall construction 66 relative to the second cover section 48. Preferably the air cylinders 82 also assist in maintaining or locking the wall construction 66 in the upright position.

The air cylinders 82 are located between the wall 50 and the base 26 and preferably concealed when the privacy enclosure 10 is in the stowed configuration for aesthetic and spatial purposes, as shown in FIG. 3. Side recesses 84 (FIGS. 5 and 9) are formed in the undersurface 68 of the wall 50. The side recesses 84 accommodate the location of the air cylinders 82 when the privacy enclosure is positioned in the stowed configuration.

Figure 6:
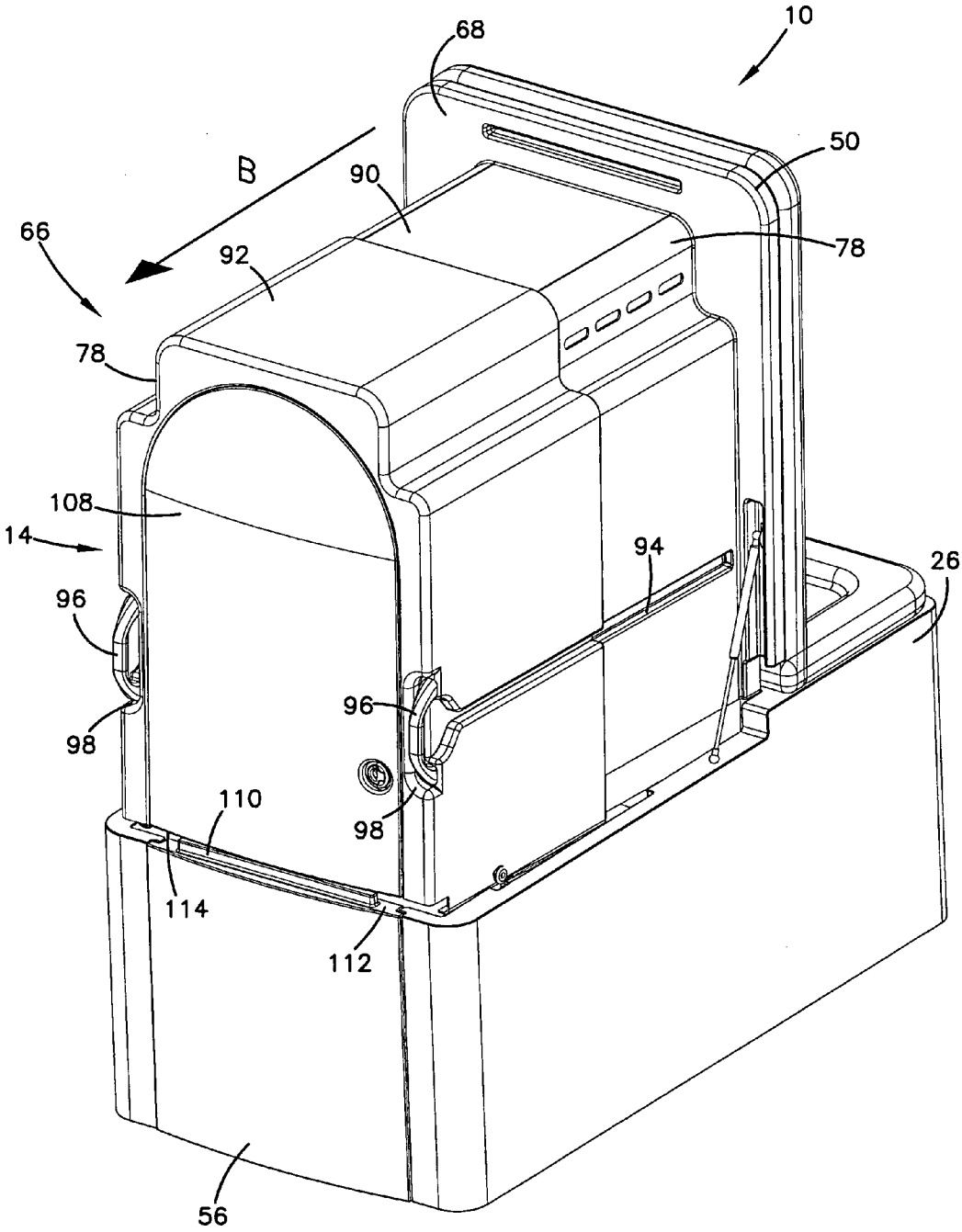
FIG. 6 is a perspective view of the privacy enclosure of FIG. 5, shown in an expanded configuration.

Referring now to FIG. 6, the wall construction 66 of the privacy enclosure 10 includes a first wall section 90 and a second wall section 92. Preferably, the first wall section 90 and the second wall section 92 are rigid wall constructions. In the illustrated embodiment, the first rigid wall section 90 is fixed to the undersurface 68 of the wall 50. The second wall section 92 is selectively moveable and configured to slide or telescope relative to the first wall section 90. In particular, the second moveable wall section 92 slides in a direction (B) outward from the wall 50 and in relation to the first fixed wall section 90. As the moveable wall section 92 slides outward from the wall 50, the privacy enclosure expands in the second lateral direction as represented by arrow B. That is, the wall construction 66 expands from a first non-extended position, shown in FIG. 5, to a second extended position, shown in FIG. 7. In the preferred embodiment, the privacy enclosure 10 typically expands from the stowed configuration to the expanded configuration in the first vertical direction A and then the second lateral direction B, the second lateral direction B being generally perpendicular to the first vertical direction A.

The second moveable wall section 92 is configured as an outer shell and slidably fits over the first fixed wall section 90. In the alternative, it is contemplated that the first wall section 90 may be configured as an inner shell that slidably fits within a stationary second wall section. Typically, the first and second wall sections 90, 92 are similarly shaped (e.g. each including neck portions 78) so the one wall section nests within the other to minimize space utilization when the privacy enclosure is being stowed.

As shown in FIG. 6, the wall construction 66 includes guide structure 94 configured to assist in positioning or laterally expanding the second wall section 92 relative to the first wall section 90. In the illustrated embodiment, the guide structure 94 is a tongue and groove arrangement formed within the first and second wall sections 90, 92. Other guide structure, such as a sliding pin and slot arrangement for example, can be used to maintain the relative positioning of the first and second wall sections. The guide structure 94 is located on the opposing sidewalls 74 of the wall construction 66. In the alternative, guide structure can be located on the top wall 76, for example.

The second moveable wall section includes handles 96 positioned so that a user can laterally pull the second wall section 92 in the lateral direction B outward from the back wall 50. Other types of handles or grasping structure, such as gripping recesses formed in the moveable wall section, for example, can be used to assist in sliding or moving the moveable wall section 92 relative to the fixed wall section 90. In the illustrated embodiment, the handles 96 are positioned within handle recesses 98 formed in the moveable wall section 92 to minimize space utilization of the privacy enclosure 10 when the privacy enclosure is in the stowed configuration.

Figure 8:
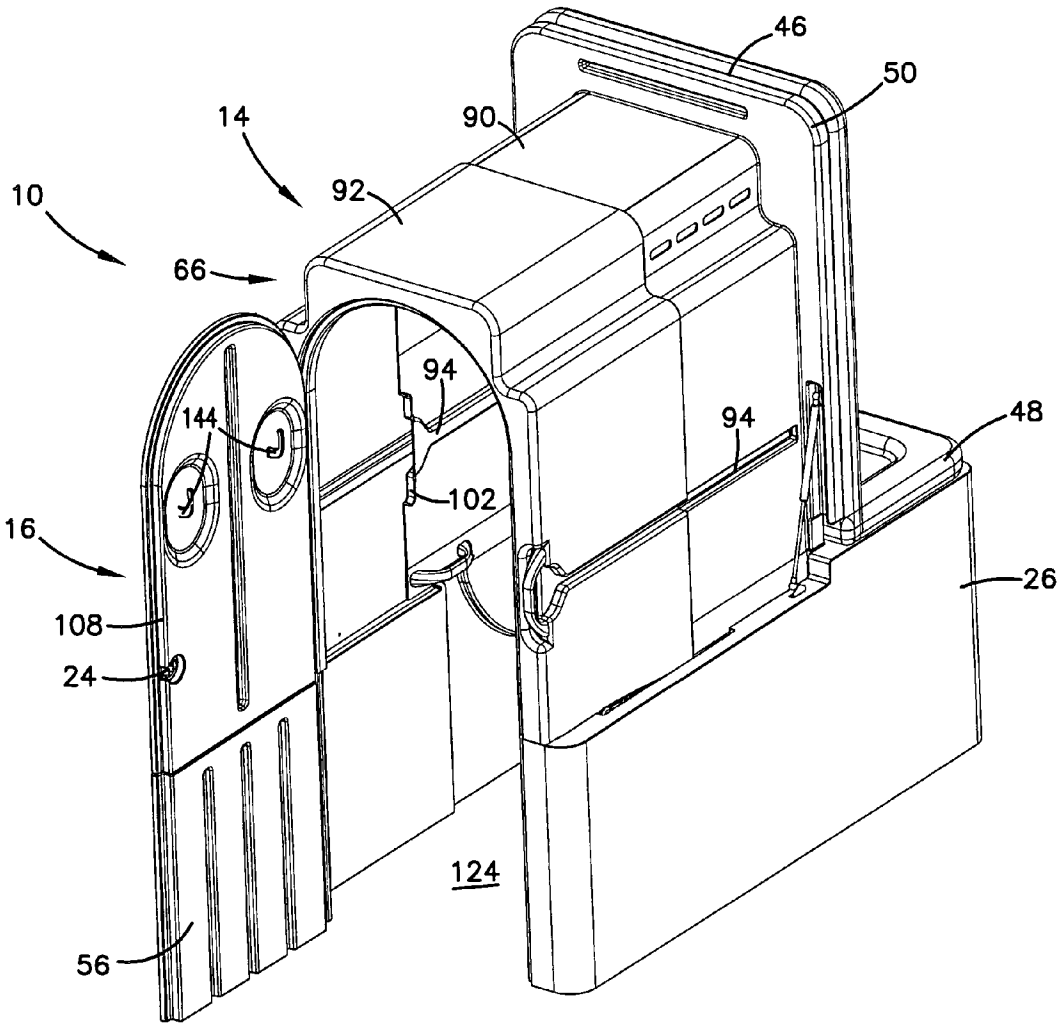
FIG. 8 is a perspective view of the privacy enclosure of FIG. 7, shown with a door of the privacy enclosure open.
Figure 9:
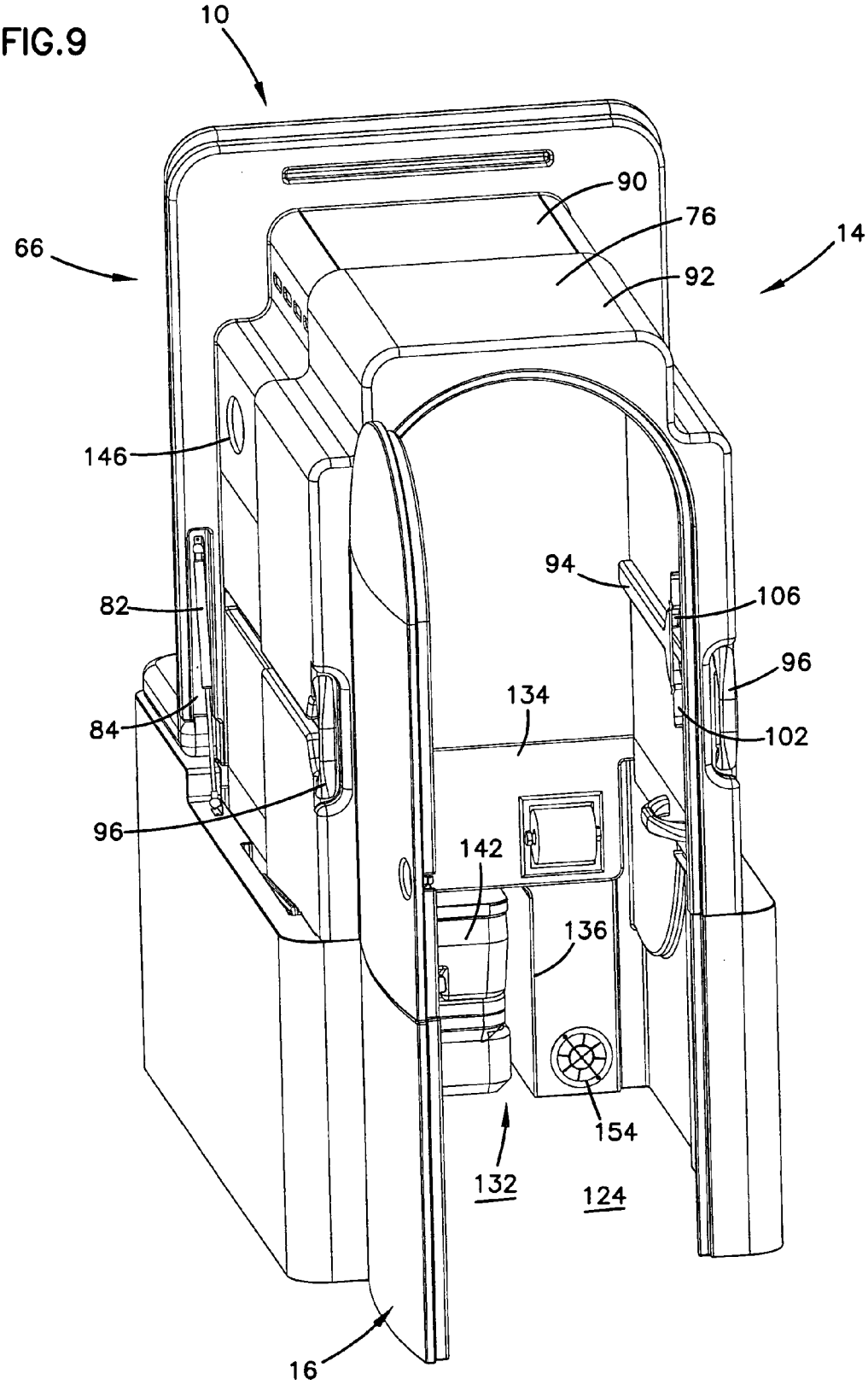
FIG. 9 is a perspective view of the privacy enclosure of FIG. 8, showing one interior arrangement of the privacy enclosure configured for use as a changing room.

Referring now to FIGS. 8 and 9, notches 102 are formed in the first wall section 90. The notches 102 are located adjacent to the guide structure 94 and aligned with the handles 96 of the second wall section 92. The notches 102 are configured to accommodate the handles recesses 98 of the second wall section 92 when the second wall section 92 is in the first non-extended position (FIG. 5). Typically the wall construction 66 includes a latching mechanism 106 (FIG. 9) located adjacent to the notches 102 and handles 96 to secure the second wall section 92 relative to the first wall section 90 when the rigid wall construction 66 is being pivoted or raised, or when the privacy enclosure is in the stowed configuration. One or both of the handles 96 can include a release mechanism (not shown) for releasing the latching mechanism 106 to laterally extend the wall construction 66.

Referring again to FIG. 6, the wall construction 66 includes a second door section 108. The door section 108 of the wall construction 66 aligns with the door section 56 of the base 26 when the privacy enclosure 10 is in the expanded configuration. The first and second door sections 56, 108 interlock to form the door 16 of the privacy enclosure 10 as shown in FIG. 2.

Figure 7:
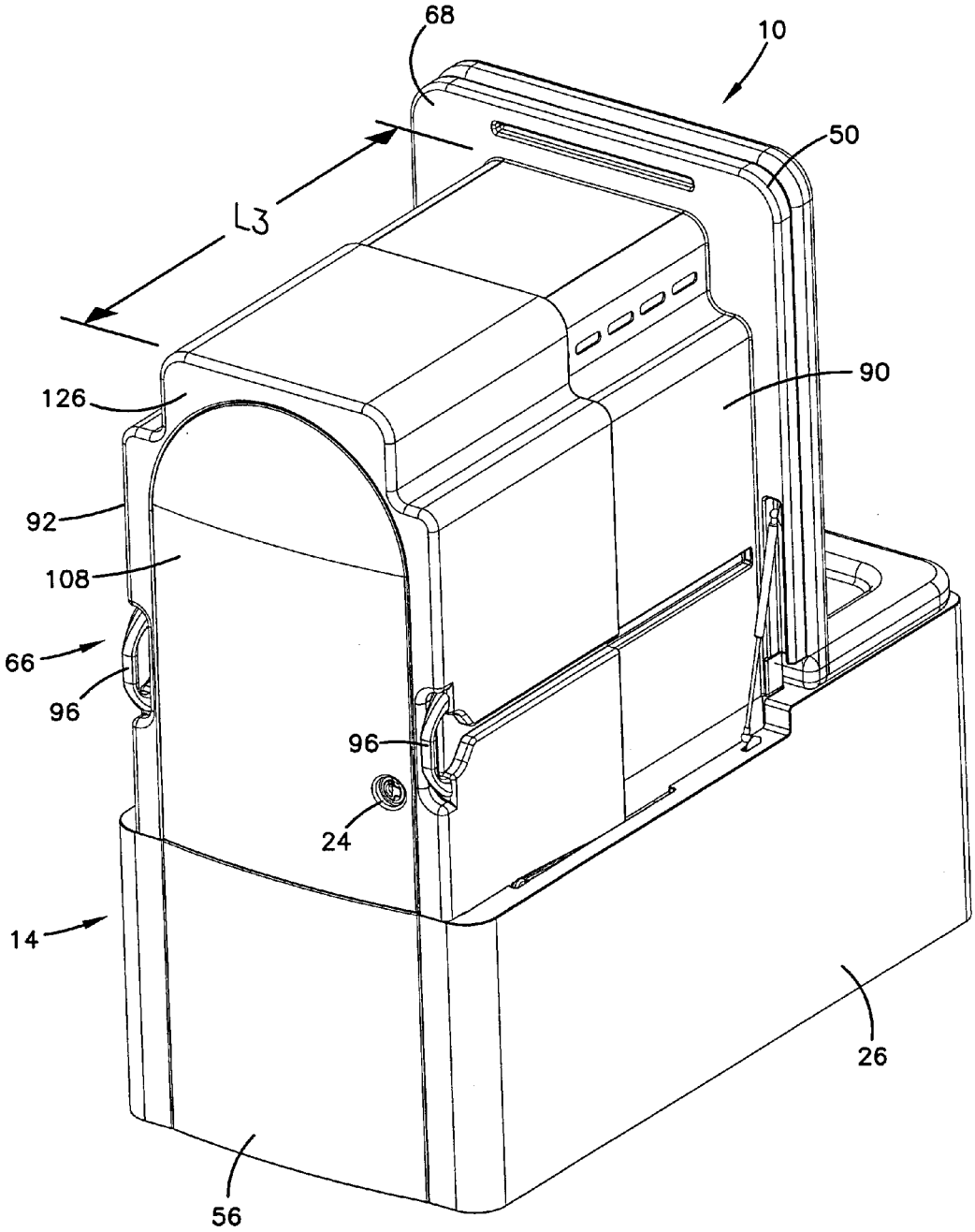
FIG. 7 is a perspective view of the privacy enclosure of FIG. 6, shown in a fully expanded and interlocked configuration.

Referring to FIGS. 5 and 6, the first door section 56 includes an interlock element 110 located along a top edge 112 of the first door section. The second door section 108 includes a recess (not shown) located along a bottom edge 114 of the second door section to accommodate and engage the interlock element 110 of the first door section 56. With reference to FIGS. 6 and 7, the wall construction 66 can be slightly lifted during the lateral extension of the enclosure such that the second door section 108 fits over the first door section 56. As shown in FIG. 8, this arrangement interlocks the first and second door sections 56, 108 so that when a user opens or closes one of the door sections, both door sections of the privacy enclosure 10 open or close.

Referring to FIG. 5, a top recess 122 is formed in the undersurface 68 of the wall 50. The top recess 122 accommodates the interlock element 110 of the first door section 56 of the base 26 when the privacy enclosure 10 is in the stowed configuration. Also, when in the stowed configuration, the interlock element 110 and the top recess 122 engage to assist in preventing any possible shifting of the top cover 34 relative to the base 26.

In accord with the principles disclosed, the privacy enclosure 10 is structurally rigid yet is configured to expand. Preferably the privacy enclosure 10 expands to a configuration wherein the enclosure provides an interior 124 of sufficient size such that an average-sized adult can use-the enclosure as a changing room. That is, an average-sized adult has sufficient head room to stand within the privacy enclosure 10 and sufficient floor space to move about within the enclosure.

In general, the privacy enclosure 10 expands to a raised height H2 (FIG. 5), and then laterally extends from a first length L2 to a second extended length L3 (FIG. 7), although the disclosed principles can be applied in a variety of sizes and applications. The raised height H2 of the enclosure 10 is generally defined between the deck 18 of the boat and the top wall 76 of the privacy enclosure when the wall 50 is in the upright or raised position. The raised height H2 is typically sized so that an average-sized adult can stand within the enclosure, and is preferably between 72 and 84 inches; and most preferably at least 72 inches. The first length L2 of the enclosure is generally defined between the undersurface 68 of the wall 50 and a front surface 126 of the wall construction 66 when the wall construction is in the first non-extended position (FIG. 5). The first length L2 is preferably between 22 and 30 inches; more preferably between 24 and 28 inches; and most preferably about 26 inches. The second length L3 of the enclosure is similarly defined between the undersurface 68 of the wall 50 and the front surface 126 of the wall construction 66 but is further defined when the wall construction 66 is positioned in the second extended position. The second length L3 is preferably between 42 and 54 inches; and most preferably at least 36 inches.

In the stowed configuration, the enclosure defines a first volume. That is, the privacy enclosure 10 occupies a first volume of space when the enclosure is in the stowed configuration. Referring to FIG. 3, the first volume is calculated from the length L1 of the first cover section 46, and the height H1 and width W1 of the base 26. The first volume is typically between 20 and 30 cubic feet; more preferably between 22 and 26 cubic feet.

In the expanded configuration, the primary enclosure 10 defines a second volume. That is, the privacy enclosure 10 occupies a second volume of space when the enclosure is in the expanded configuration. Referring to FIGS. 3, 5 and 7, the second volume is calculated from the second extended length L3 and height H2 of the wall construction 66, and the width W1 of the base 26. The second volume is typically between 60 and 80 cubic feet; more preferably between 50 and 110 cubic feet.

Figure 10:
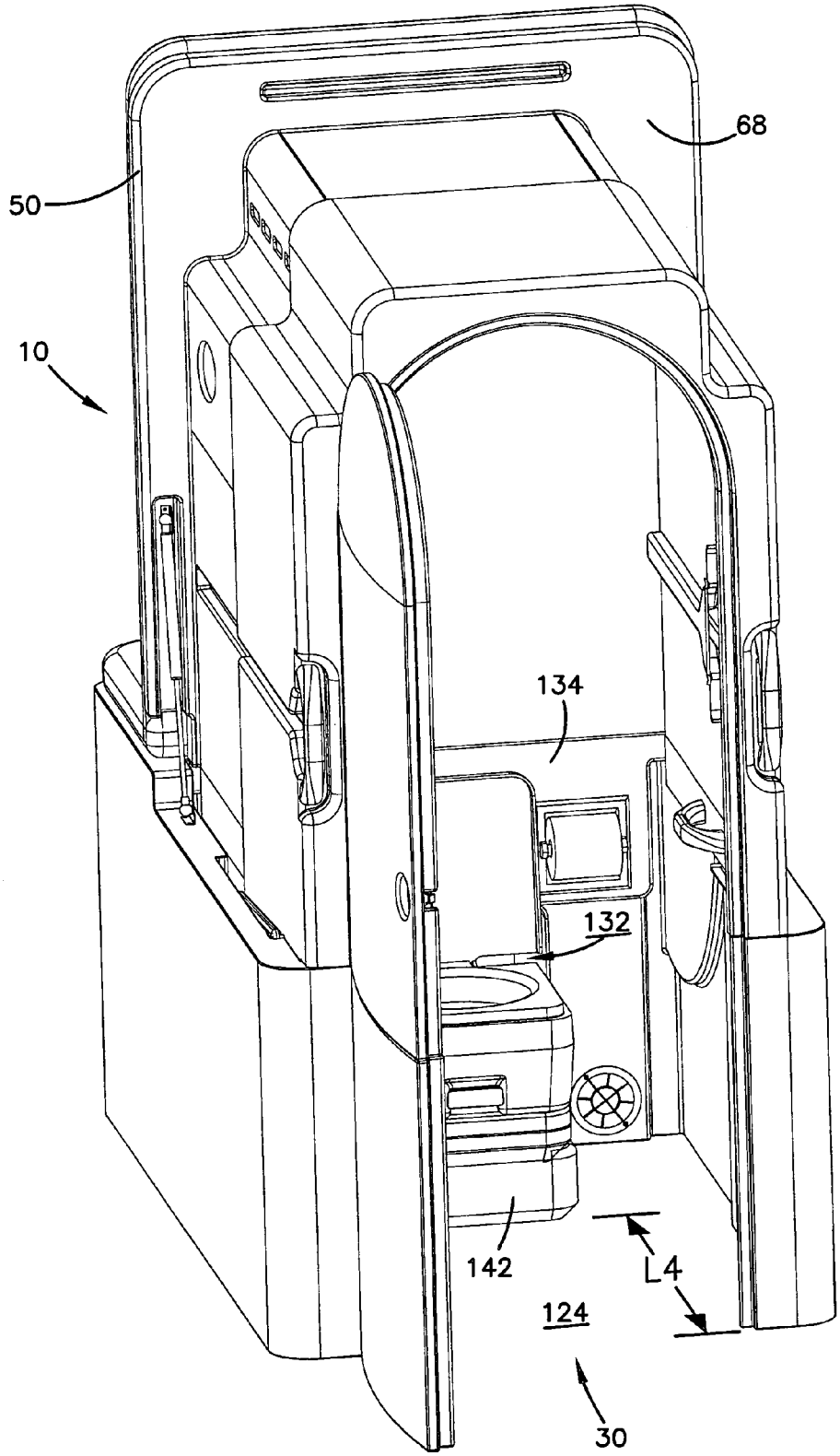
FIG. 10 is a perspective view of the privacy enclosure of FIG. 9, showing another interior arrangement of the privacy enclosure configured for use as a toilet room.

Referring now to FIGS. 9 and 10, the privacy enclosure 10 can include amenities for use as a rest room or private toilet area. In the preferred embodiment, the base 26 includes a storage area or compartment 132 positioned adjacent to the changing area or interior 124 (FIGS. 8–10) of the enclosure 10. The compartment 132 is separated from the changing area or interior 124 by a partition 134. The partition 134 includes an opening 136. The opening 136 and compartment 132 are sized and configured to stow a toilet 142. The partition 134 can include a door or cover (not shown) to hide the storage compartment if desired. In certain embodiments, the second cover section 48 (FIG. 8) can be configured to pivot or open to provide top access to additional storage space that surrounds the compartment 132.

The toilet 142 is typically a portable-type toilet having a removable tank, or a type that can be emptied at a pump station. The toilet 142 is preferably configured to move or slide out from the storage compartment 132 (FIG. 10) for use; and easily slide back into the compartment 132 for storage when not in use (FIG. 9). By this design, the privacy enclosure 10 can be used as a restroom having a particular room area, then be used as a larger changing room when the toilet 142 is slid back into the compartment 132.

Still, as shown in FIG. 10, the interior 124 of the privacy enclosure 10 is preferably large enough so that even when the toilet 142 is slide out from the compartment 132 and positioned within the interior 124, a user has head room to stand and floor space to move about within the enclosure 10. In particular, the privacy enclosure 10 is sufficiently large enough such that the interior 124 includes a toilet region and a changing room region when the toilet 142 is slide out from the compartment 132. Specifically, sufficient floor space is provided between the front end 30 and the toilet 142 when the toilet is positioned within the interior 124. The floor space preferably has a length L4 (FIG. 10) in the range of about 36 inches and 28 inches, and more preferably at least 24 inches, between the front end 30 of the enclosure and the toilet 142. As can be understood, by sliding the toilet 142 into the storage compartment 132, the changing room region is enlarged.

The privacy enclosure 10 can include hooks and bars positioned within the interior 124 to hang for example, clothing, towels, bags, and other personal items. In the illustrated embodiment of FIG. 8, hooks 144 are located on the inside of the door 16. It is contemplated that hooks, bars, or other convenience-type fixtures or structures can be located on the wall 50 or wall sections 90, 92 of the wall construction 66 as desired. The fixtures or structures can be remolded within the wall and door structures of the privacy enclosure 10 or may be fastened.

In the illustrated embodiment, a port 146 (FIG. 9) is located within the wall construction 66. The port 146 can include an opening of any configuration and size. The port 146 provides light within the enclosure when the door 16 is closed. A number of ports or windows can be provided within the wall sections 90, 92, or provided in the top wall 76 for a sky-light effect. To further illuminate the interior 124, the wall construction 66 can be made of an opaque or translucent material that allows light to pass through the wall construction into the interior of the enclosure, such as unpigmented polyethylene, for example. It is contemplated, however, that the wall construction 66 can be made any material suitable to provide the preferred rigid construction in accord with the principles disclosed.

Referring to FIG. 9, the illustrated privacy enclosure 10 also includes restroom fixtures, for example, a ventilation duct 154. A fan or blower system (not shown) can be located within the storage compartment 132 of the base 26 and configured to provide air flow through the ventilation duct 154. Other typical restroom amenities can be included in the privacy enclosure in accord with the principles disclosed.

The above specification provides a complete description of the PRIVACY ENCLOSURE. Since many embodiments of the invention can be made without departing from the spirit and scope of the invention, certain aspects of the invention reside in the claims hereinafter appended. While preferred dimension have been provided herein, it will be appreciate that the dimensions can be varied from those specifically discussed herein without departing from the broad principles of the present invention.

What is claimed is:

1. A privacy enclosure arrangement, comprising:

a) a lower base;

b) a stowable enclosure coupled to the lower base, the stowable enclosure including:

i) a rigid outer wall structure that expands from a stowed configuration to an expanded configuration in a first direction and then a second perpendicular direction;

c) wherein at least a portion of the lower base and the rigid outer wall structure define an expanded interior when the rigid outer wall structure is in the expanded configuration;

d) a storage compartment located adjacent to the expanded interior; and e) a toilet positioned within one of the storage compartment and the expanded interior, and moveable between the storage compartment and the expanded interior.

2. The arrangement of claim 1, wherein the toilet is arranged to selectively slide out from the storage compartment when the rigid outer wall structure is in the expanded configuration.

3. The arrangement of claim 1, wherein the storage compartment is defined by the lower base.

4. A privacy enclosure arrangement, comprising:

a) a lower base;

b) a stowable enclosure coupled to the lower base, the stowable enclosure including:

i) a rigid outer wall structure configured to expand from a stowed configuration to an expanded configuration, the rigid outer wall structure expanding from the stowed configuration to the expanded configuration in a first direction and then a second direction perpendicular to the first direction;

c) wherein at least a portion of the lower base and the rigid outer wall structure define an expanded interior when the rigid outer wall structure is in the expanded configuration;

d) a storage compartment located adjacent to the expanded interior; and e) a toilet positioned within one of the storage compartment and the expanded interior, and moveable between the storage compartment and the expanded interior.

* * * * *